US010000924B2

(12) United States Patent
Lasry et al.

(10) Patent No.: US 10,000,924 B2
(45) Date of Patent: Jun. 19, 2018

(54) ESTABLISHING BARRIERS WITH MODULAR WALL STRUCTURES

(71) Applicants: Richard Lasry, Golden Beach, FL (US); John Lasry, Golden Beach, FL (US)

(72) Inventors: Richard Lasry, Golden Beach, FL (US); John Lasry, Golden Beach, FL (US)

( * ) Notice: Subject to any disclaimer, the term of this patent is extended or adjusted under 35 U.S.C. 154(b) by 0 days. days.

(21) Appl. No.: 15/351,328

(22) Filed: Nov. 14, 2016

(65) Prior Publication Data

US 2017/0138045 A1 May 18, 2017

Related U.S. Application Data

(60) Provisional application No. 62/254,219, filed on Nov. 12, 2015.

(51) Int. Cl.

| | |
|---|---|
| ***E04B 2/74*** | (2006.01) |
| ***E04B 7/10*** | (2006.01) |
| ***B65D 90/08*** | (2006.01) |
| *E04B 2/82* | (2006.01) |

(52) U.S. Cl.

CPC ..... *E04B 2/7448* (2013.01); *B65D 90/08* (2013.01); *E04B 7/105* (2013.01); *E04B 2/745* (2013.01); *E04B 2/82* (2013.01); *E04B 2002/7461* (2013.01); *E04B 2103/06* (2013.01)

(58) Field of Classification Search

CPC ..... E04B 2/7448; E04B 2103/06; E04B 2/82; E04B 2/745; E04B 2002/7461; E04B 1/3211; E04B 1/32; E04B 1/3205; E04B 2001/3276; E04B 7/105; E04B 7/102; B65D 90/08; B65D 90/024; B65D 88/08

USPC ..... 52/80.1, 80.2, 81.2, 81.6, 81.4, 82, 86, 52/244, 245, 246, 248, 249; 248/910, 248/346, 346.2; 160/351, 352, 171

See application file for complete search history.

(56) References Cited

U.S. PATENT DOCUMENTS 3,468,083 A * 9/1969 Hausermann ..... E04L 31/32 52/236.1
3,513,608 A * 5/1970 Nagrod ..... E04L 31/32 52/199
3,532,403 A * 10/1970 Koski ..... A47B 69/00 312/140.2
3,956,860 A * 5/1976 Andrews ..... B65D 90/024 52/236.2

(Continued)

*Primary Examiner* — Robert Canfield
*Assistant Examiner* — Matthew J Gitlin
(74) *Attorney, Agent, or Firm* — Fleit Gibbons Gutman Bongini & Bianco PL; Paul D. Bianco; Gary S. Winer

(57) ABSTRACT

A wall segment is stood upon a surface by first positioning a curved wall segment upon the surface. The wall segment has a lower ground contacting surface, an upper surface opposite the lower ground contacting surface, left and a right side surfaces each extending from the lower surface to the upper surface, one or more panels, and a curved frame including at least one frame segment sized and dimensioned to retain a panel, the frame defining a curved outer periphery where the segment contacts the surface. A vessel is positioned proximate the curved frame, the vessel being shaped to conform and nest into the curvature of the outer periphery of the frame where the segment contacts the surface. The vessel is attached to the frame, and weight is added to the vessel.

19 Claims, 10 Drawing Sheets

(56) References Cited

U.S. PATENT DOCUMENTS 4,019,332 A * 4/1977 Lamy ..... E02L 33/04 405/211
4,023,317 A * 5/1977 Bettger ..... E04L 31/32 52/262
4,036,390 A * 7/1977 Morse ..... B65D 90/08 220/4.13
4,305,518 A * 12/1981 Boyd ..... B65D 90/08 220/4.13
4,407,319 A * 10/1983 Shultz ..... E04H 15/003 135/87
4,665,664 A * 5/1987 Knight ..... E04L 31/3211 52/81.5
5,112,023 A * 5/1992 Sowers ..... A63B 63/083 248/519
5,379,786 A * 1/1995 Lynam ..... E04H 15/003 135/118
5,771,954 A * 6/1998 Benner ..... A47G 5/00 160/135
5,813,662 A * 9/1998 Langkruis ..... E04H 12/2246 160/135
6,957,876 B1 * 10/2005 DeMars ..... A47B 77/10 108/26
8,601,729 B2 * 12/2013 Pitcher ..... G09F 15/0018 160/135
8,973,642 B2 * 3/2015 Lawson ..... E04H 1/1272 160/135
9,315,983 B1 * 4/2016 Sedehi ..... E04H 3/00
2004/0163778 A1 * 8/2004 Fritsche ..... E04B 2/7433 160/371
2005/0269046 A1 * 12/2005 Freeman ..... E04H 15/003 160/351
2011/0272303 A1 * 11/2011 Peterken ..... B65D 88/08 206/223
2013/0206662 A1 * 8/2013 Wilhelms ..... C02F 3/327 210/170.03
2014/0306584 A1 * 10/2014 DeMars ..... A47F 9/00 312/140.2
2015/0021319 A1 * 1/2015 Avery ..... B65D 90/24 220/4.16
2015/0052827 A1 * 2/2015 DaCosta ..... E04B 1/3211 52/80.1
2015/0164283 A1 * 6/2015 Guidos ..... A47K 3/30 4/607

* cited by examiner

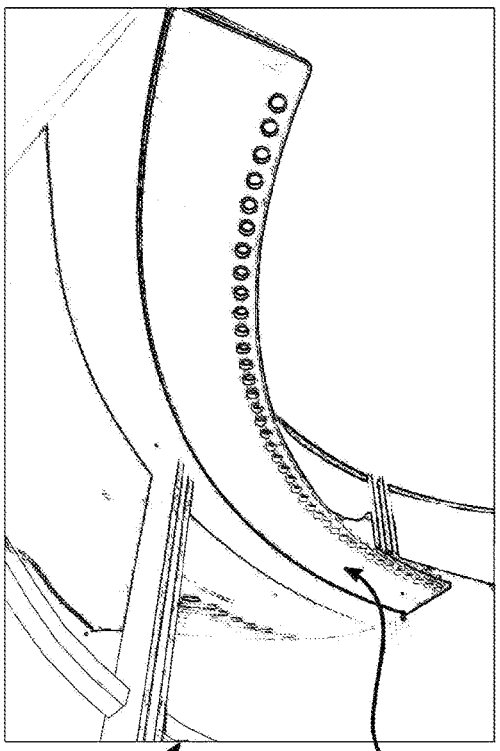
FIG. 11
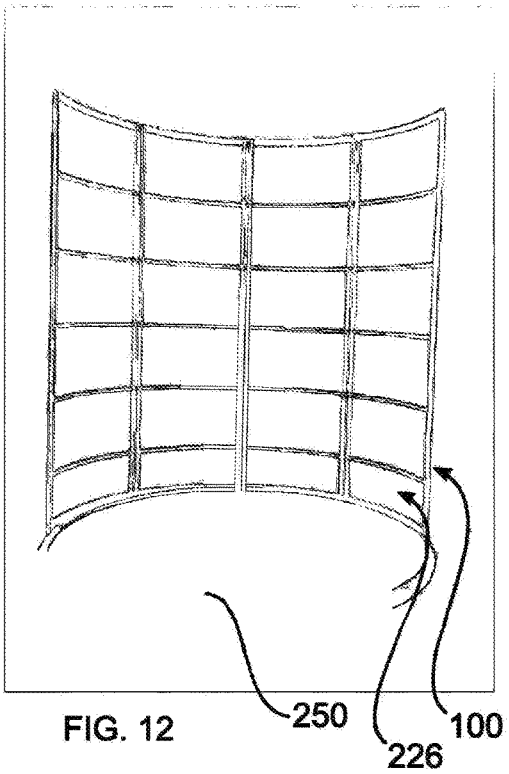
FIG. 12
FIG. 13
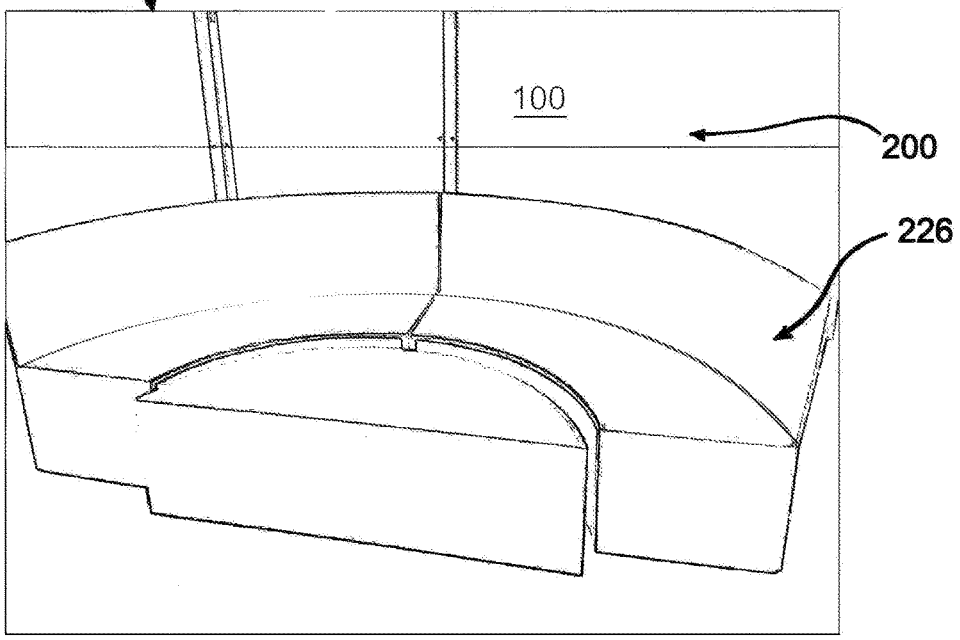

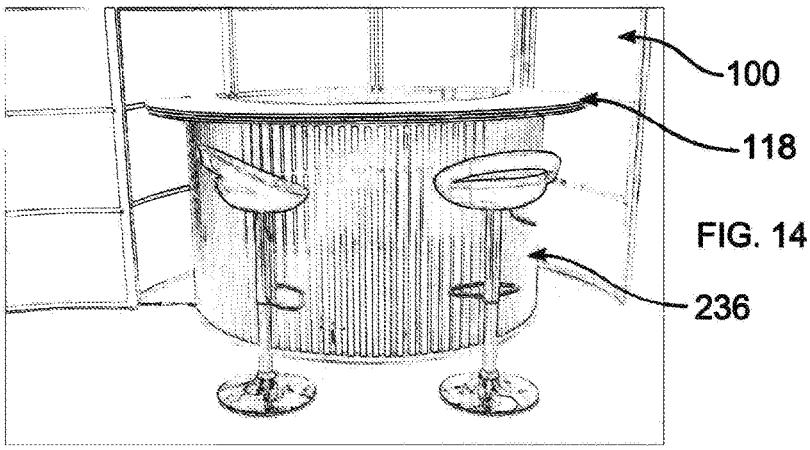
FIG. 14
FIG. 15
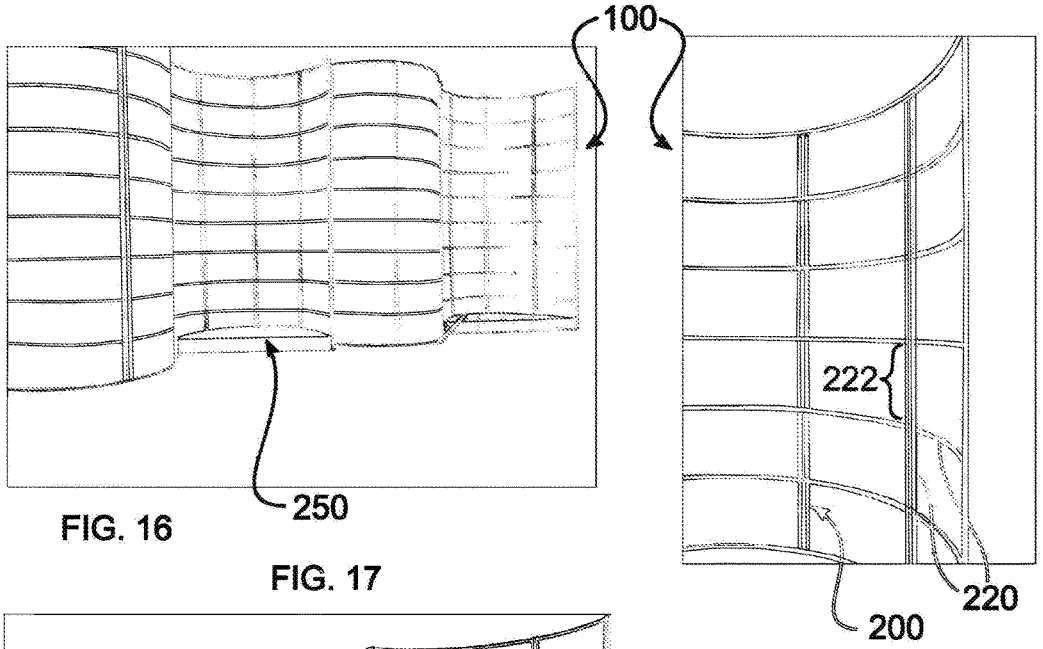
FIG. 16
FIG. 17
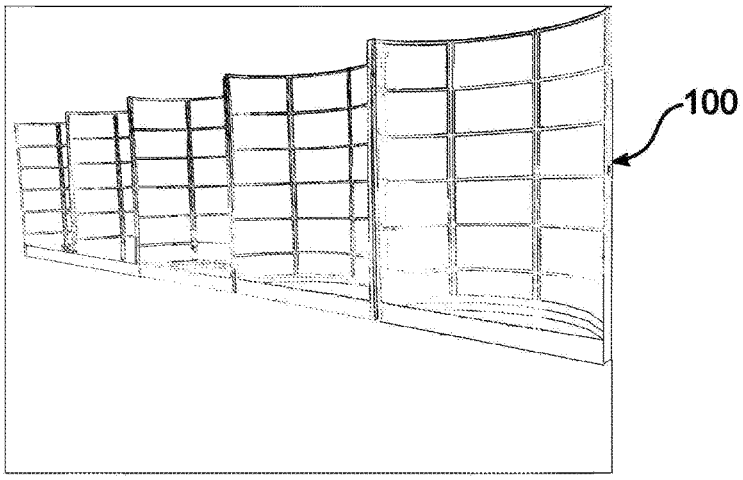

ESTABLISHING BARRIERS WITH MODULAR WALL STRUCTURES

CROSS-REFERENCE TO RELATED APPLICATIONS

This application claims the benefit of related U.S. Patent Application 62/254,219, filed Nov. 12, 2015, the contents of which are incorporated herein by reference in their entirety.

FIELD OF THE DISCLOSURE

The disclosure relates to a system and method for erecting modular walls, and in particular, walls which are freestanding.

BACKGROUND OF THE DISCLOSURE

Portable room dividers are shown at www.screenflex-.com, and are available in a variety of fixed heights from 4 feet to 8 feet. The dividers include a number of 22 inch panes hinged together and mounted on casters, with end panels having transversely mounted supporting legs. The panels can be folded to form a variety of configurations.

A freestanding wall that is 10 feet high is shown at www.ezupdirect.com (SKU FSSWS10W), which includes a frame mounted on transverse supporting legs. Railskirts can be added to change a configuration of the wall, which is designed to hold advertising banners.

SUMMARY OF THE DISCLOSURE

In an embodiment of the disclosure, a method of standing a wall segment upon a surface comprises positioning a wall segment upon the surface, the wall segment having: a lower ground contacting surface, an upper surface opposite the lower ground contacting surface, left and a right side surfaces each extending from the lower surface to the upper surface, one or more panels, and a curved frame including at least one frame segment sized and dimensioned to retain a panel, the frame defining a curved outer periphery where the segment contacts the surface; positioning a vessel proximate the curved frame, the vessel shaped to conform and nest into the curvature of the outer periphery of the frame where the segment contacts the surface; attaching the vessel to the frame; and adding weight to the vessel.

In variations thereof, the lower surface of the wall segment that is positioned forms the arcuate portion of the periphery of a cylinder, the cylinder having a circular or elliptical cross-section; the frame forms a half-cylinder standing on end when positioned upon the surface; the portion of a periphery of a cylinder is the peripheral portion of the cylinder defining an arc of between 10 and 180 degrees; the lower and upper surfaces are curved, and the left and right sides are straight; the lower and upper surfaces are curved, and the left and right sides are curved; and/or the lower and upper surfaces each define a first curvature extending from the left to the right side, and the left and right surfaces each define a second curvature extending from the lower to the upper side.

In other variations thereof, the first and second curvatures are different; the frame of the wall segment positioned is formed from rigid tubes; the panels are polymeric sheets that are at least one of transparent and translucent; the weight added to the vessel is water; the vessel is a basin for holding a liquid; the method further includes clamping the basin to the frame; the method further includes connecting a first leg of an L-shaped bracket to the frame, and positioning a second leg of the L-shaped bracket beneath the vessel; and/or the method further includes positioning an end of a bracket into an interior of the vessel, and connecting the bracket to the frame.

In another embodiment of the disclosure, a wall segment, comprises a first frame forming a lower surface, an upper surface opposite the lower surface, and left and right side surfaces each extending from the lower surface to the upper surface, the frame forming one or more interior frame segments, the lower surface forming a curve defining an interior surface of the frame, the upper surface forming a curve; one or more panels that are one of transparent and translucent, each of the one or more panels sized and dimensioned to fit within one of the frame segments of the frame; a basin having a side forming a complementary curve with respect to a curve of the frame, the basin thereby mateably positionable and nestable within the curve of the lower surface; a bracket connectable to the frame, a portion of the bracket positionable under the basin; and a bracket connectable to the frame, a portion of the bracket positionable within the basin.

In variations thereof, the wall segment further includes at least one first tube vertically mounted to the first frame proximate the upper surface of the first frame to dispose an open channel formed by the tube proximate the upper surface of the first frame.

In another variation thereof, a second frame is provided as described above, the second frame having a second tube vertically mounted to the second frame proximate the lower surface of the second frame to dispose an open channel formed by the tube proximate the lower surface; The first and second tube aligned when the second frame is positioned on top of the first frame with the lower surface of the second frame in overlapping conformity to the upper surface of the first frame, one or more of the open channels of the at least one first tubes thereby aligned with an open channel of the second tube, an elongate object positionable within the aligned open channels to secure a position of the second frame on top of the first frame.

In a variation thereof, the one or more panels are each attached within a frame segment using adhesive; and/or an edifice is formed using a plurality of wall segments as described above, and further includes one or more struts and at least one vertical column, the one or more struts each connected to a wall segment and at least one of the at least one vertical column.

In a further embodiment of the disclosure, an edifice, comprises a plurality of wall segments, each including a first frame forming a lower surface, an upper surface opposite the lower surface, and left and right side surfaces each extending from the lower surface to the upper surface, the frame forming one or more interior frame segments, the lower surface forming a curve defining an interior surface of the frame, the upper surface forming a curve, and one or more panels each sized and dimensioned to fit within one of the frame segments of the frame; one or more struts; and at least one vertical column, the one or more struts each connected to a wall segment and at least one of the at least one vertical column.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein:

FIGS. 10 and 11 depict segments of the disclosure including attached shelving that is illuminated;

FIG. 12 depict segments of the disclosure forming a backdrop for a lecturer, and including a shaped base;

FIG. 13 depicts furniture shaped to conform to a contour of segments of the disclosure;

FIG. 14 depicts a bar sized and dimensioned to be received within joined segments of the disclosure;

FIG. 15 depicts a person supported by frames which form segments of the disclosure;

FIG. 16 depicts segments of the disclosure connected in a reversing pattern forming a wave-shaped wall, with segments including weighted bases;

FIG. 17 depicts segments of the disclosure forming a protective barrier at an elevated location;

DETAILED DESCRIPTION OF THE DISCLOSURE

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Figure 1:
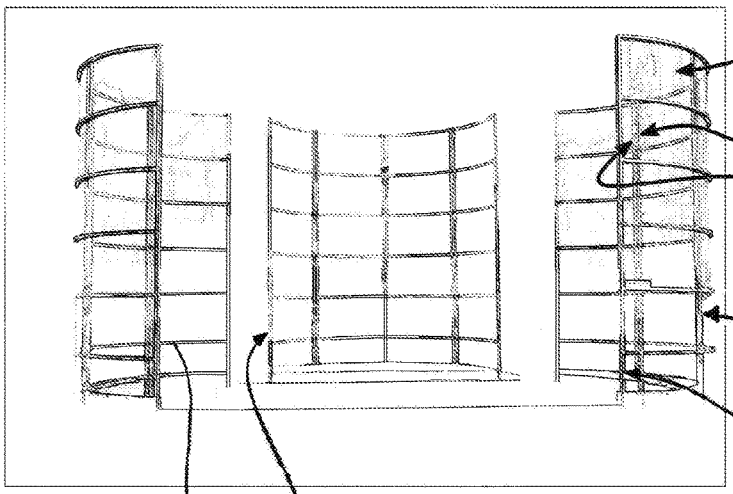
FIG. 1 depicts five wall segments of the disclosure disposed in free-standing configuration upon a beach.

With reference to FIG. 1, a wall segment 100 is comprised of a rigid frame 200 and one or more panels 300 retained within frame 200. In the embodiment shown, there are a plurality of transparent panels 300 secured by a frame 200 formed from rigid extrusions. Segment 100 is curved to form an arcuate portion of a circle or ellipse. For example, segment 100 can form a portion of the arc of an outer periphery of a cylinder having a circular or elliptical cross-section. In an embodiment, segment 100 has a curvature of a sufficient portion of an arc to enable segment 100 to be securely freestanding. It should be understood that the ground contacting portion of segment 100 can have a curve of a first radius or arc, and an upper portion away from the ground contacting portion can have a different curve, or can be planar. A small extent of an arc may be sufficient to enable segment 100 to be freestanding if undisturbed, for example, 5-15 degrees, although, generally, larger angles impart greater stability. In an embodiment, the extent of arc is 10 degrees. In the embodiment shown, the segments 200 form 180 degrees of a circular arc. In accordance with the disclosure, and angular extent from 0 degrees to form a flat panel, to 360 degrees to form a tube of circular or oval cross-section, is contemplated.

Figure 2:
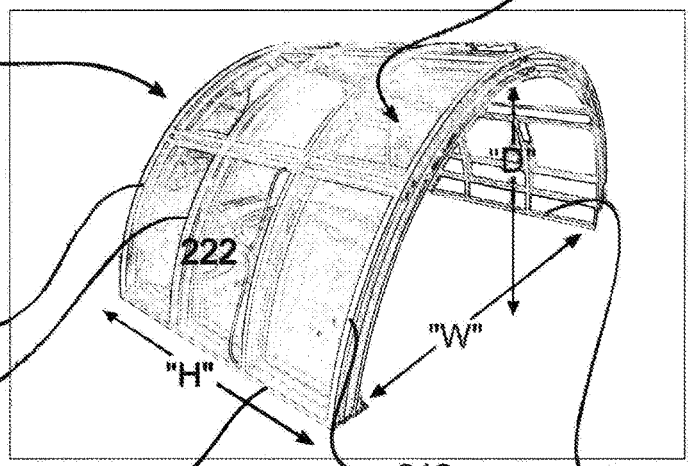
FIG. 2 depicts a plurality of segments of the disclosure stacked for transport or storage.
Figure 3:
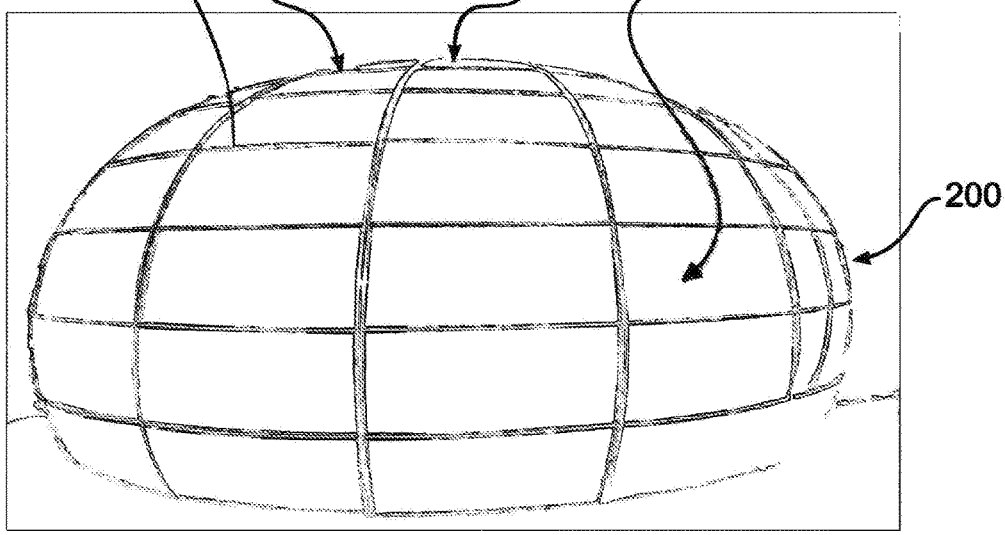
FIG. 3 depicts an assembly of segments of the disclosure forming an enclosed and covered recreational space occupied by people.
Figure 4:
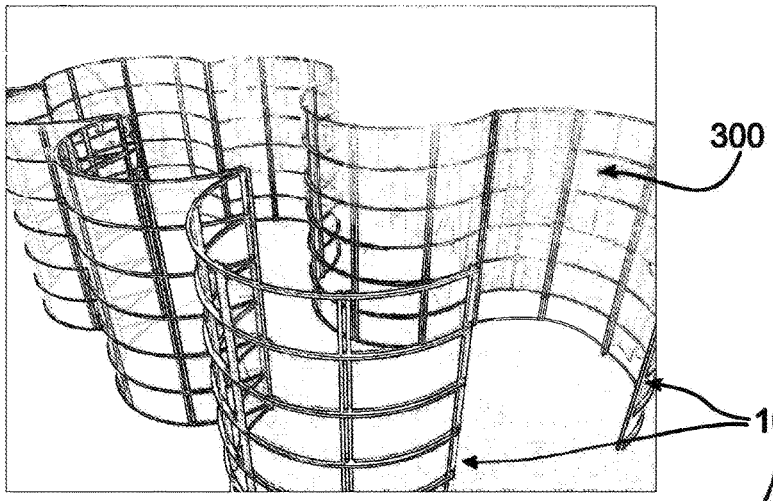
FIG. 4 depicts a walkway formed of segments of the disclosure.

Segments 100 can form a planar surface that is curved, as shown in FIGS. 1-2, or can form a more complex curve, for example forming a curvature along two separate or transverse axes, including for example segments 100 that form a portion of a domed surface 120, as shown in FIG. 3. Further, segments of the type shown in FIGS. 1-2 can be combined with panels that curve along two axes.

Frame 200 can form grid portions each sized and dimensioned to receive one or more transparent, translucent, or opaque panels 300, or can be configured without panels 300, or with panels 300 in selected positions. In an embodiment, one or more grid portions do not contain a panel 300. Frame 200 can independently provide all of the structural strength to enable a segment 100 to be freestanding, or may cooperate with integrated panels 300 to form a structure that is reinforced by both frame 200 and one or more panels 300. In one embodiment, frame 200 includes extruded metal or polymeric lengths which include notches, grooves, or slots for receiving panels 300.

Metals can include any metal known or hereinafter developed, including for example pure or alloyed compositions of steel, iron, titanium, magnesium, tin, copper, brass, zinc, and aluminum. In the embodiment shown, aluminum is selected due to its low cost, corrosion resistance, high strength to weight, and attractive appearance, as shown for example in FIG. 15. Alternatively, a synthetic material of adequate strength and corrosion resistance can be selected, including for example ultra-high molecular weight polyethylene, or polyoxymethylene, for example DELRIN. Frame 200 can be molded, cast, stamped, milled, or 3d printed as a unitary part, using any known means, or can be assembled as a collection of molded, cast, stamped, milled, or 3d printed parts. Assembly of frame subparts can be carried out by any known means of fastening, including for example welding, brazing, soldering, gluing, ultrasonic welding, or other form of heat or chemical bonding. Additionally or alternatively, the subparts can be connected by screws, riveting, bolting, clipping, ligature, interlocking, or any other known or hereinafter developed form of mechanical interlock In the embodiment shown, lengths of extruded aluminum are screwed together at borders 202, 204 to form a unitary structure comprising a plurality of segments 100. As can be seen in FIG. 1, a designated area can be formed by separate assemblies each containing a plurality of segments 100. A frame can include upper, lower, left, and right side portions 212, 214, 216, and 218, respectively, and cross portions 220 which provide further strength, and which separate areas for discrete panels 300.

During the assembly, panels 300 can be inserted between frame 200 portions, or within channels or grooves within frame 200 portions. As such, assembly can cause panels 300 to be secured within frame 200. Caulking or other sealant and adhesive can be used to further secure panels 300. In an embodiment, only an adhesive is used to attach panels 300 to frame 200. In a further embodiment, panels 300 are sandwiched between horizontal and vertical frame members 224, and can alternatively or additionally be pop riveted or fastened by any known means to the frame for added strength. Panels 300 can be pop riveted or fastened only on one side of segment 100, and a molding can be applied to hide the rivets or other fastener. In an embodiment, a pin or dowel is inserted through frame 200 and panel 300 to retain removable panels 300 in place.

In FIG. 2, it may be seen that segments 100 are separated relative to each other, and have been stacked for storage or transportation. Segments 100 can be fabricated of any height, indicated by arrow "H" in the example of FIG. 2, or a desired height can be accomplished by stacking segments 100 on top of one another, and fastening them along bordering edges. Typical sizes include 5', 10', 15', and 20' height segments 100 are used, although substantially shorter or taller segments can be fabricated or assembled from a plurality of stacked segments 100. Widths may also vary as required. It can be advantageous to form the segments with a width, shown as arrow "W" in the example of FIG. 2, of not more than 8 feet, and a depth, shown by arrow "D" of not more than 4 feet, so that a segment 100 fits within two adjacent positions of a pallet rack, or fits within the bed of a full size pickup truck. However, segments can be formed of any length, width, and height.

Figure 5:
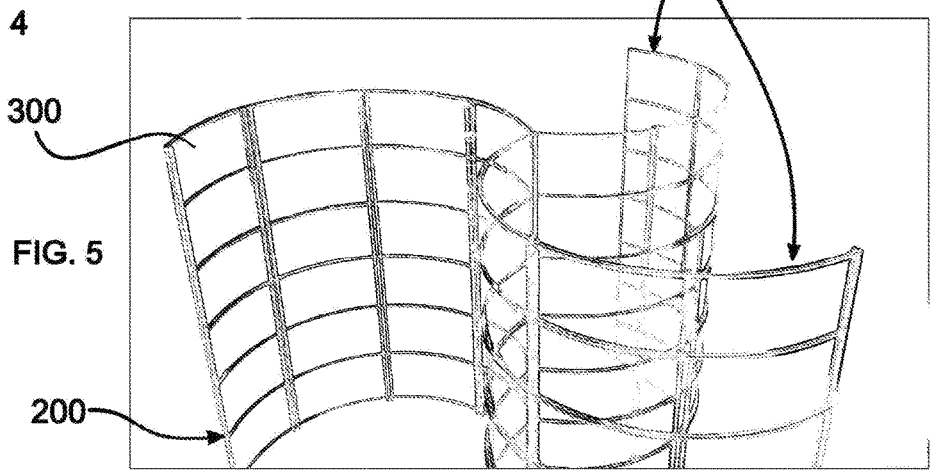
FIG. 5 depicts separate and connected work areas formed by segments of the disclosure.
Figure 6:
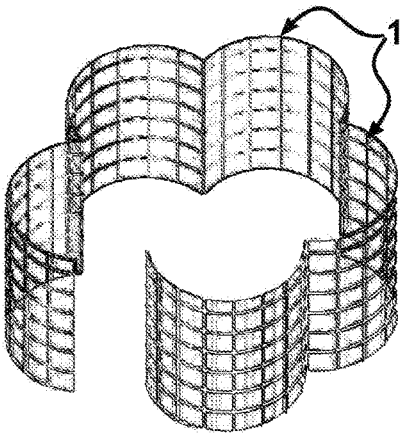
FIGS. 6 and 7 depict alternative perimeter enclosures formed with connected segments of the disclosure.
Figure 7:
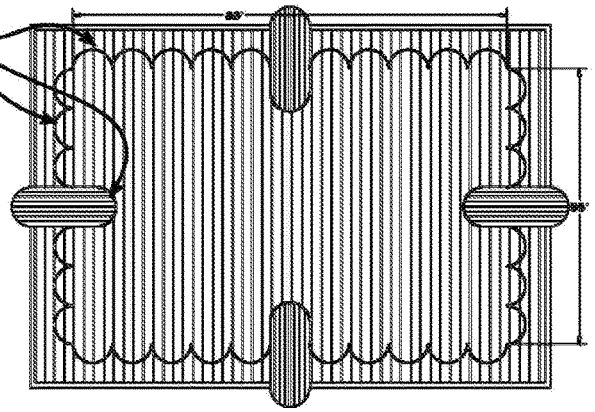
Figure 9:
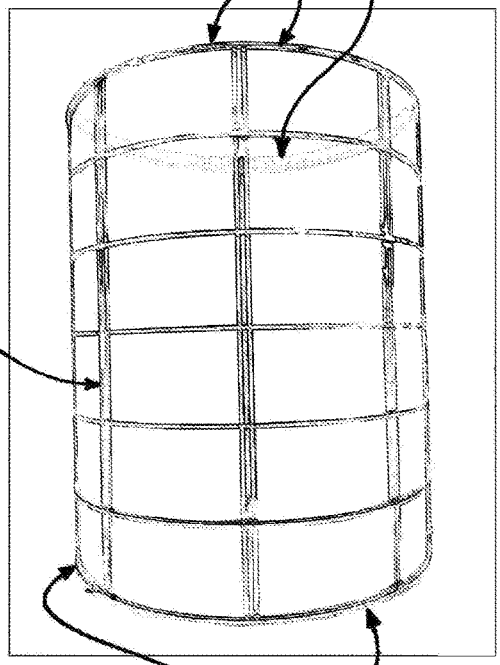
FIG. 9 depicts segments of the disclosure forming a columnar enclosure.

In the example of FIGS. 1-2, segments form semi-circular cylinders, which are 10 feet high in the example of FIG. 1, and 5 feet high, shown as arrow "H", in the example of FIG. 2. While segments 100 of FIG. 1 are formed as a singular piece 10 feet high, it should be understood that two segments of the type shown in FIG. 2 could be stacked to form 10 foot high segments. As such, if two segments were to be connected, a tubular structure would be created, such as is shown in FIG. 9. A larger structure can be created by angularly disposing adjacent segments 100 relative to each other, as shown for example in FIGS. 4-7 and 16-17. In the embodiments of FIGS. 5 and 16, segments 100 are connected to be oriented in a reverse orientation with respect to one another, whereby if adjacent panels were pivoted at a connecting edge, the panels would nest within one another. In an embodiment, a plurality of segments 100 are interconnected along a single edge, such as is shown in FIG. 5.

Segments 100 can be mutually connected by one or more hinges including a pivot, disposed along a mutually contacting edge, or by a flexible material, for example including natural rubber or a synthetic polymer, or braided or solid cable or wire. In an embodiment, a standard door-hinge is fastened to adjacent segments 100. In this embodiment, the hinge leaves can be unbolted from segments 100 to separate the segments, or the hinge pins can be removed. Segments 100 can be overlapped or disposed adjacent to each other, and screwed or otherwise fastened together by passing a material through or around adjacent or overlapping portions of segments 100, using any known or hereinafter developed manner, including as examples wire or tie-wraps. Segments 100 can also be mutually interconnected by welding, brazing, soldering, gluing, ultrasonic welding, or other form of heat or chemical bonding. Additionally or alternatively, segments 100 can be connected by riveting, bolting, clipping, ligature, interlocking, or any other known or hereinafter developed form of mechanical interlock. The method of interconnecting segments 100 can be selected based on the strength of the connector, and the wind loads and other stresses to which segments 100 are expected to be subjected.

Figure 24:
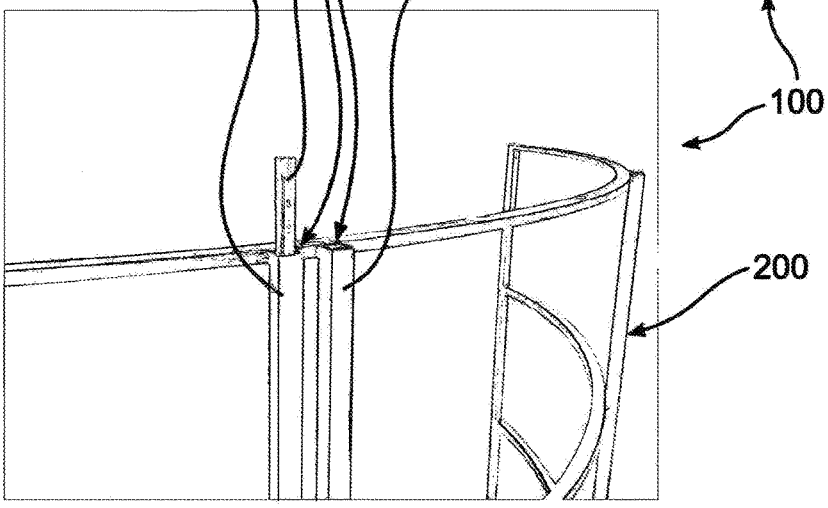
FIG. 24 depicts a connecting pin for securing relatively vertically aligned segments of the disclosure.

When segments 100 are connected one above the other with respect to a supporting surface, the segments can be disposed with a lower edge of an upper segment resting upon an upper edge of a lower segment. To maintain an alignment of such upper and lower segments 100, the mutually contacting segments can be connected as described above. Alternatively or additionally, as illustrated in FIG. 24, a connecting pin 244 can be inserted in a channel 238 of tube 240 and/or tube 242. Pin 244 can be threaded on one or both ends, to threadably be connected to upper and/or lower segment 100. Alternatively, a clip, pin, screw, through-bolt, or other fastener can secure pin 244 to one or both of upper and lower segment 100.

Panels 300 can be fabricated from any suitable material, and can be transparent, semi-transparent, reflective, opaque, and/or colored or tinted. A segment 100 can have a mixed of different panels 300, or can have no panels or a subset of frames containing panels. Panels 300 can be fabricated of glass, which can be tempered, coated, and/or laminated, or plastic, including for example LEXAN (polycarbonate), ACRYLIC (polymethylmethacrylate), BUTYRATE (cellulose acetate butyrate), PETG (glycol modified polyethylene terephthalate), or any other known or hereinafter developed polymeric material. Panels 300 may also be fabricated with other natural or synthetic materials, including for example fiberglass, carbon fiber, wood, textile, padding, sound insulation, acoustic transducers, video projectors, or electronic devices. A Mondrian style pattern can be formed by mixing different colored panels 300, or different types of panels 300.

In an embodiment, a 4 foot by 8 foot panel that is 5 feet height has a frame 200 which forms 12 subframes 222 for holding 12 panels that are each 18.5 inches high by 33.5 inches wide. It should be understood that these sizes are chosen for aesthetics and practicality, and that any number of subframes and any number of panels of any practical size can be provided. Indicia, for example directions, a brand name or other trademark, or other visible marking can be printed upon or affixed to one or more panels 300.

Figure 8:
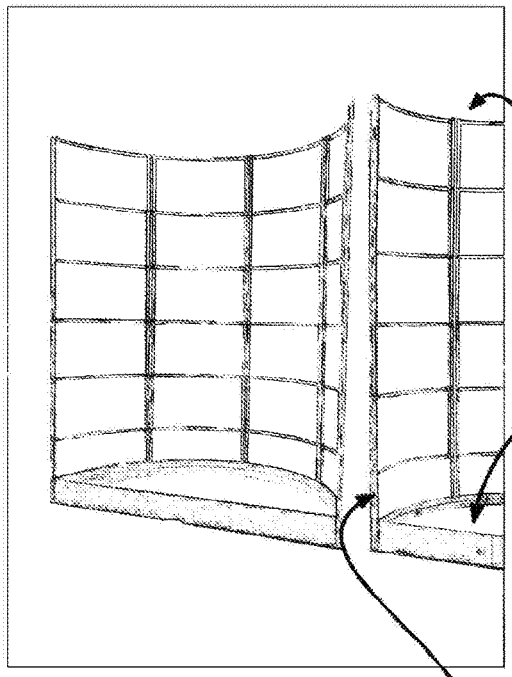
FIG. 8 depicts segments of the disclosure including weighted bases.

With reference to the various figures, it may be seen that by arranging segments relative to each other, and/or by interconnecting all or groups of segments 100, barriers can be created which separate one or more areas of an environment from another. For example, a wall can be constructed which blocks wind (see, e.g. FIGS. 1, 8 and 17), water spray, rain, sound, or other movement of matter or energy across the barrier. Additionally, structures can be formed by interconnecting segments 100, including as examples a walkway (FIG. 4), adjacent booths or stations (FIG. 5), corral or display area (FIG. 6), event perimeter (FIG. 7), stage (FIGS. 12 and 16), eating/drinking/refreshment stand (FIGS. 10 and 14), lounge/seating/dining area (FIG. 13), and comforting/safety perimeter (FIG. 17).

Referring now to FIGS. 12, 16, and 18-19, a base 250 is positioned proximate a lower portion 226 of one or more segments 100. Base 250 can be shaped to complement the contour of lower portion 226, and can project beyond a perimeter formed by the one or more segments 100, as shown in FIG. 12. A floor covering can be placed on top of the base, and in the example shown, a podium is placed upon base 250 to facilitate presentation by a lecturer. A presentation space thus created by base 250 can similarly be used for an entertainer, for example a dancer, singer, or comedian.

While the segments 100 of FIG. 12 appear to form a sufficient portion of an arc to be freestanding, segments 100 can be attached to base 250 to provide additional stability to the segments 100, as well as for base 250. Similarly, where segments 100 do not form a sufficient portion of an arc to be reliably freestanding, or wind loads or other forces are too great, attachment to base 250 can provide needed stability.

To increase stability, base 250 can be constructed of materials sufficiently heavy to impart a desired stability to segments 100 suitably strongly attached to base 250. In the embodiments of FIGS. 1, 8, and 16-17, base 250 forms a vessel for containment of a weight, in this example water. A weight material that is heavy, but is easily and inexpensively supplied and removed, and which may optionally be discarded when no longer needed, is advantageous, and water therefore is useful. Similarly, sand may also be used, whether loose or in bags. Alternatively, metallic or masonry materials can be used, or any object of sufficient weight. The weighted material can be placed into the containment portion of base 250. Alternatively, it should be understood that segments 100 can be weighted without the use of base 250, or can be staked, tied, or connected to each other, to weights, or to surrounding structures or materials whether or not base 250 is used.

Figure 22:
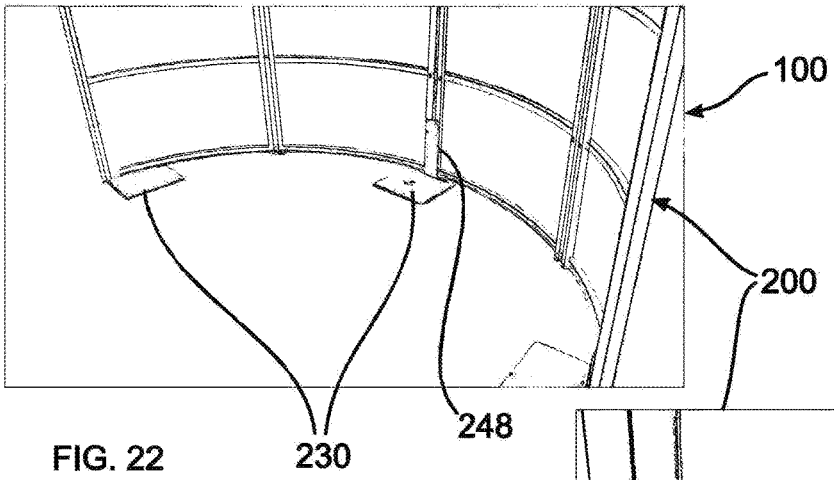
FIG. 22 depicts enlarged stabilizing plates of the disclosure, when extend along upright portions of a segment of the disclosure.
Figure 23:
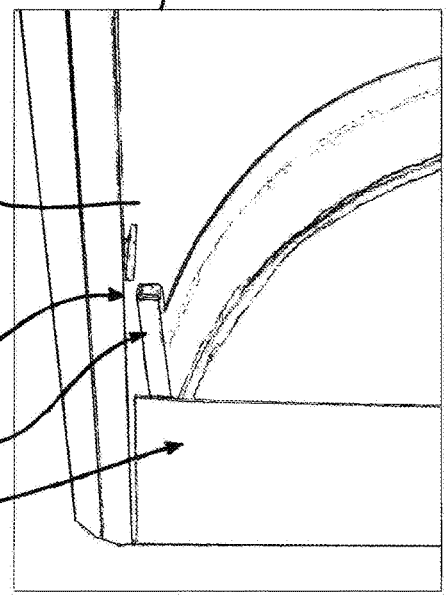
FIG. 23 depicts the stabilizing plate of FIG. 22, fastened together with the mounting bracket of FIG. 20, to a segment of the disclosure.

In an embodiment, base 250 is permanently fastened, for example by welded, riveting, bonding, or any of the fastening methods mentioned herein, to one or more segments 100. However, it can be advantageous for storage, transportation, or flexibility in configuration, if base 250 can be securely attached to one or more segments 100 after segments 100 are positioned in an intended layout configuration. With reference to FIGS. 18-21, base 250 can be removably attached to frame 200. In one embodiment, shown in FIG. 18, a plate 230 is disposed with an elongated flat portion 232 resting upon a supporting flooring, and includes a hook portion 234 which extend upwards relative to the floor to extend over a cross-member 228 of frame 200. Hook portion 234 can be figured to cover a portion of cross-member 228, or can surround cross-member 228, and/or can be threadably attached by a bolt or screw 256, clipped, or otherwise attached to cross-member 228. In an embodiment, base 250, shown in greater detail in FIG. 22, can be positioned on top of flat portion 232, to secure same to the flooring, and to thereby lend stability to frame 200 and segment 100. Alternatively or additionally, sandbags or other heavy objects can be placed upon plates 230. For a 4 by 8 by 5 foot panel, as described herein, three plates 230 are placed at opposite ends and the middle of a lower frame cross-member 228 of frame 200, and are overlaid by 300 to 3,000 pounds of weight. More or less weight, and greater or fewer plates 230 can be used, depending on the forces which may operate to destabilize segments 100, for example an expected wind speed, and a number and size of panels 300 within segment 100. Plates 230 can be much larger than illustrated, and can include an upright portion 248 that extends along, and can be fastened to, an upright portion of frame 200, as described for fastening to a cross-member of frame 200, as shown in FIGS. 22-23.

An advantage to the stabilizing methods described herein is that anchors need not be inserted into a floor or ground structure, or to a wall or tree. Accordingly, segments can be deployed without harming or damaging an environment. Alternatively, if staking, fastening, or securing to the environment is not harmful and/or if a more permanent structure is desired, this may be carried out in addition to other methods described herein.

Where furniture is provided within an area defined by segments 100, the furniture can substitute for base 250, and can be used to stabilize segments 100 as described. In a variant of this embodiment, sandbags or other stabilizing weights can be hidden by the furniture.

Figure 18:
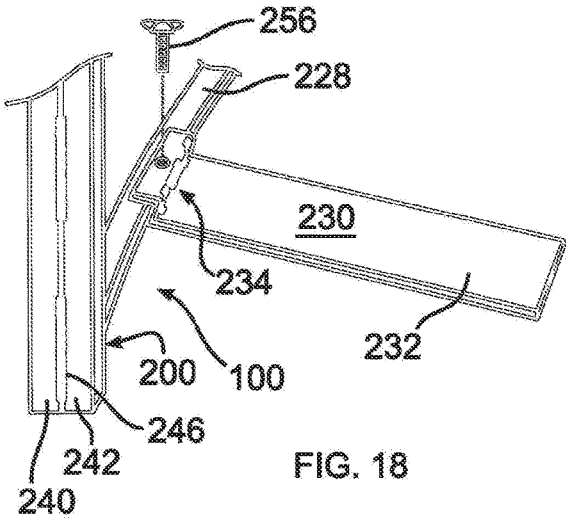
FIG. 18 depicts a mounting plate of the disclosure.
Figure 19:
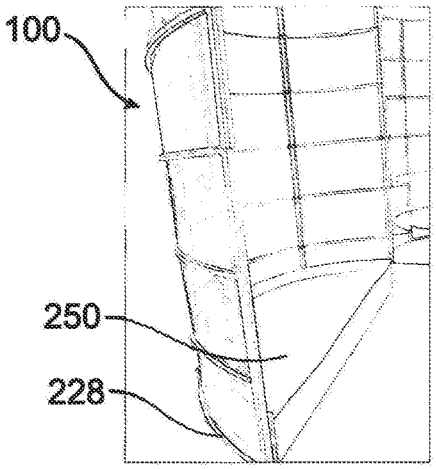
FIG. 19 depicts a segment of the disclosure including a stabilizing base of the disclosure, that can be weighted.

In FIG. 18, it may be seen that portions of frame 200 can include multiple tubular or rectangular channel structures, in this example extruded aluminum square tubes 240 and 242, that are fastened together to provide additional strength, in this example by welds 246. A gap can be provided between adjacent square tubes 240, 242, to admit passage of panel 300 edges, to secure panel 300 within segment 100.

Figure 20:
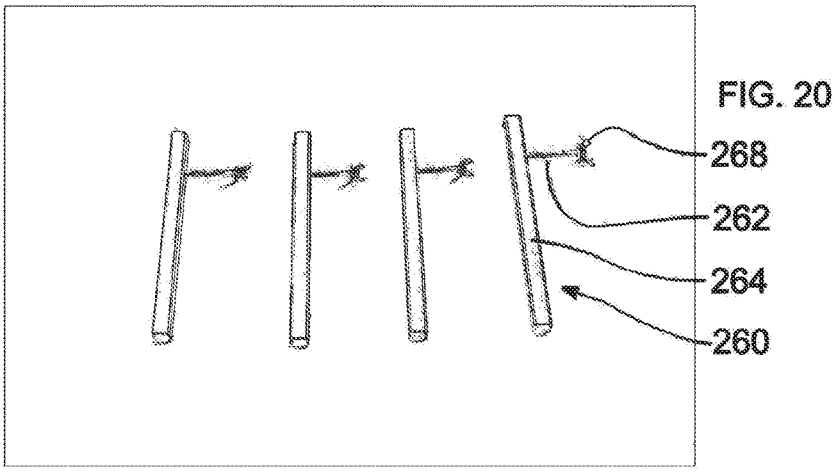
FIG. 20 depicts mounting brackets of the disclosure.
Figure 21:
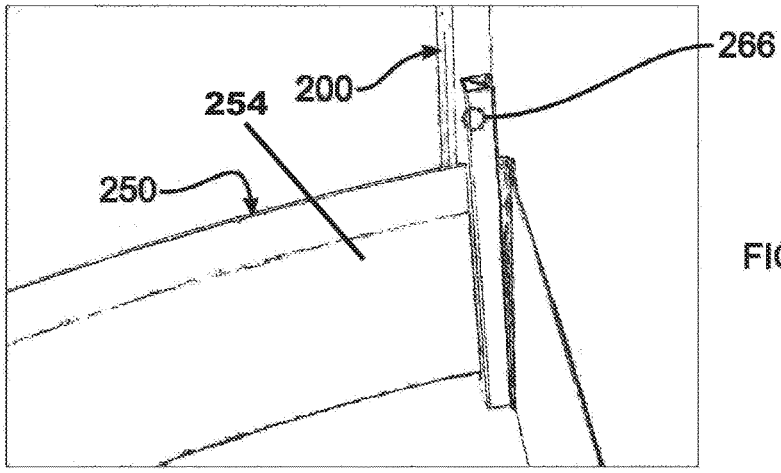
FIG. 21 depicts a mounting bracket of FIG. 20, connected to the segment base shown in FIG. 19.

In an alternative embodiment, shown in FIGS. 20 and 21, elongated brackets 260 include a threaded shaft 262 fastened within a rectangular tube 264. In the embodiment shown, shafts 262 are welded within tube 264, although any manner of fastening can be used, including for example bonding, brazing, or bolting. An aperture 266 is formed within a portion of frame 200, for example one or both of tubes 240, 242. As can be seen in FIG. 22, base 250 forms a basin with an upright wall 254 which abuts frame 200. In use, tube 264 is passed into base 250 to abut wall 254, and shaft 262 is passed through aperture 266. Shaft 262 is secured within aperture by a nut 268, to thereby urge wall 254 into contact with frame 200, to stabilize segment 100 by preventing segment 100 from moving away from base 250. Brackets 260 can be combined with plates 230 for additional strength, as illustrated in FIGS. 22-23. In an embodiment, threaded shaft 262 passes through both upright portion 248 of plate 230 and a portion of frame 200.

Further in accordance with the disclosure, a roof structure 270 fabricated from textile, natural material, synthetic material, wood, fiberglass, metal, plastic, or any other material that is selected for a desired set of characteristics. Such characteristics can include, for example, protection from sun, rain, falling debris, or other matter or energy source, or for decorative or symbolic purposes, as illustrated in FIG. 1. The roof structure can provide further stabilization to segments 100, and can connect a plurality of segments 100 together. Roof 270 can be attached to segments 100 by any known means, including any of the fastening means described elsewhere herein. A roof 270 can additionally be formed of curved, angled, or bent portions of frame 200, as illustrated in FIG. 3. Thus, the segments according to the disclosure are not only decorative, they are also structural and can be weight bearing or load bearing.

Figure 25:
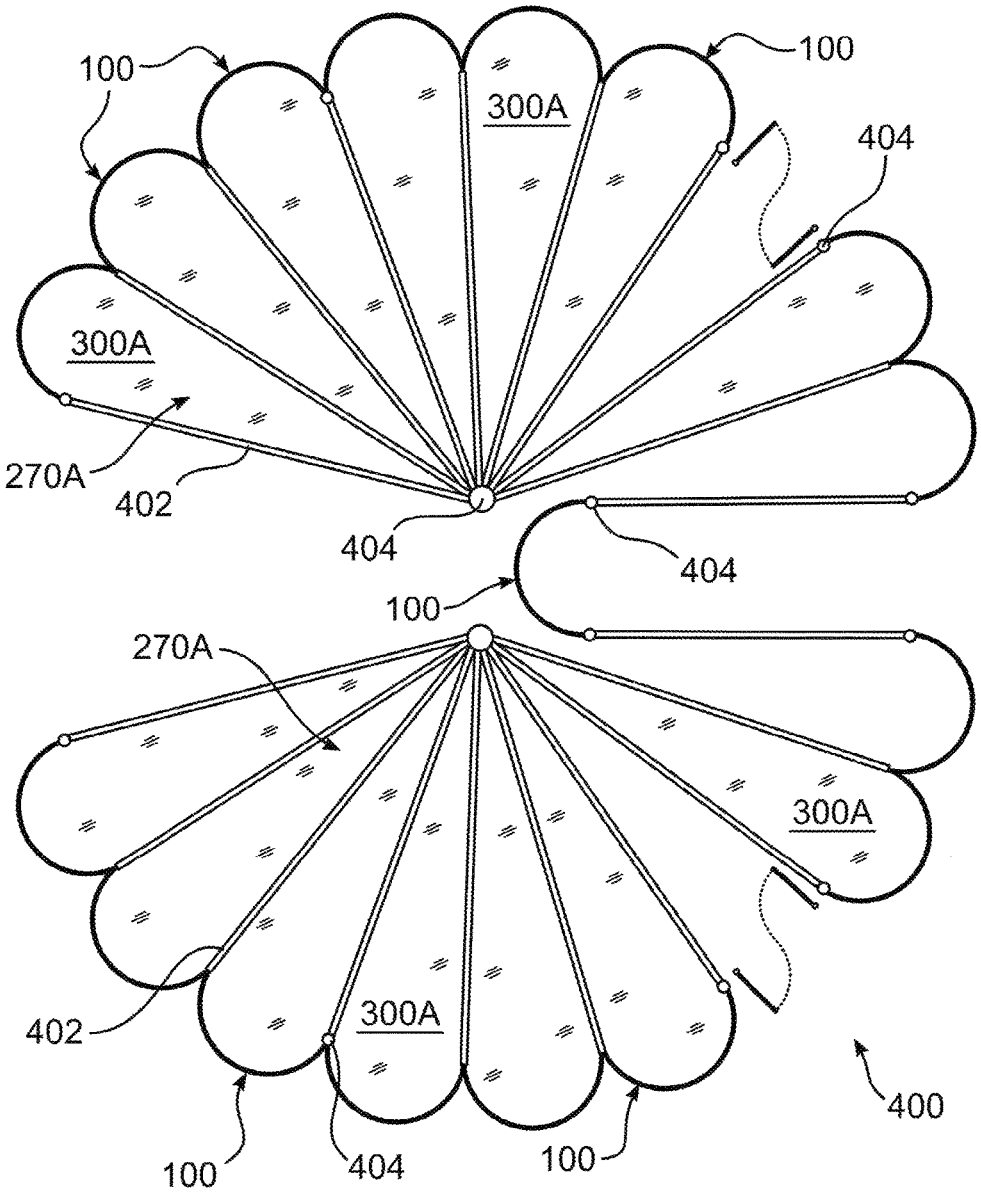
FIG. 25 depicts a covered building structure formed with segments, struts, and roof panels of the disclosure.
Figure 26:
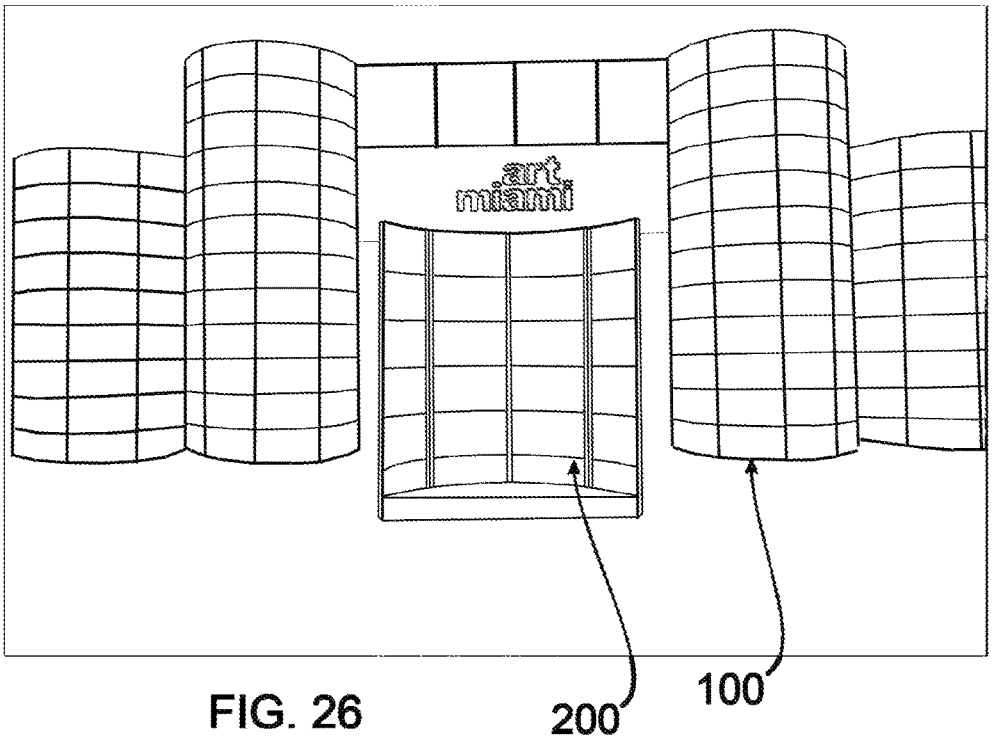
FIG. 26 depicts segments of the disclosure utilized as a façade.

With reference to FIG. 25, a plurality of segments 100 can be mutually connected to form an external perimeter of a building structure 400. A roof structure 270A is formed by connecting trusses or struts 402 from a top edge of a segment 100, or a joined portion at the top of two or more segments 100, extending either to additional segments 100, or to one or more vertical stabilizing columns 404, or other stable structure, if desired or required for strength. Roof panels 300A can be fabricated from any of the materials described for panels 300 herein, including rigid or flexible material, including plastic or textile, for example, that is any or all of transparent, colored, printed, or opaque. Struts 402 and panels 300A can be attached by any of the means described herein for frame members 220 or panels 300, respectively, including screws, clips, brackets, pins, snaps, straps, cables, bolts, welding, brazing, or crimping, for example. Methods of attachment which are reversible are advantageous, in that the structure can be disassembled and stored, or certain of the parts, such as segments 100, can be redeployed in other installations, until needed again to form a larger structure.

Various appurtenances can be attached to frame 200 or panels 300 to provide additional decoration or functionality to segments 100. As shown in FIGS. 9 and 11, a curtain is attached to a curved panel, such as is described in our U.S. Patent Publication 2014/0138038 entitled Forming Curtains. Curtain supports 110 can be fastened to segment 100 using any known means, including for example clips, snaps, bolts, adhesive, hook and loop fasteners, crimping, or clamping. In FIG. 11, the curtains have not yet been installed. In an embodiment, curtains are not installed, and curtain supports serve a decorative purpose, as particularly if colored or lit by colored lights, or can serve as shelves support for other hanging articles.

Figure 10:
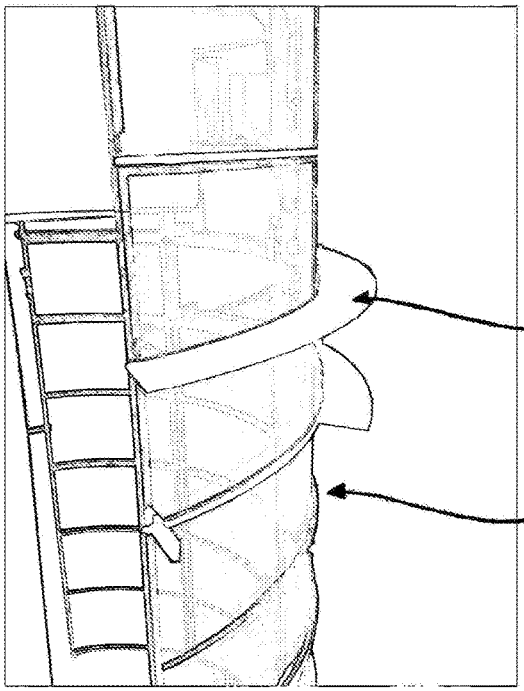

Shelving 118 can be attached to segments 100 in a manner similar to curtain supports 110, and can provide decoration, or support for articles, including articles for display. As shown in FIGS. 10, 11, and 14, shelves 118 may be lit by white or colored lights, and may be light transmissive, as can be curtain supports 110. Accessories such as shelves 118 can be configured to readily attach to frames 200, frame segments 210, or panels 300. In an embodiment, this is accomplished by fasteners which operate without tools, such as snaps, buckles, catches, click-in connectors, hooks, hook and loop fasteners, tongue and groove fastener, or any other known or hereinafter developed fastener.

Segments 100 of the disclosure can be formed as curved substantially transparent panels, as shown in the figures, and form multifunctional, modular building or protective structures. Segments 100 can be arranged to enclose an area, creating and defining a desired space, indoors or outside. Trees and building columns can be encircled and remain visible, or they can be decorated or hidden using segments 100. When arranged around a designated area, segments 100 delineate a space, control elements of the weather, and do not waste space, as they are relatively very thin. Segments 100 can be arranged to block unwanted views, for example construction, servant's entrances, industrial equipment, or other objects. For trade shows and exhibits, segments 100 can be used to create vendor booths, and to separate a trade floor into functional areas. They can be used in many instances where a canvas tent may otherwise have been used, with a relatively much smaller amount of time, expertise, and labor required. For example, segments 100 can be easily moved or repositioned as wind or light shifts over time. Segments 100 can provide protection from wind, sound, and rain. Curtains can be added to further reduce light or visibility, or to provide privacy. Segments 100 can provide a backdrop for a show or presentation, and can form a projection screen using panels 300, or fabric mounted to one or more segments 100. Segments 100 may further serve as mounting point for electronic displays, artwork, or other visual media. Segments 100 are sufficiently strong to support a roof, and/or lighting, such as show spotlights or the like, or a chandelier, hanging decorations, and or loudspeakers. Strategically placed, segments 100 can identify and direct traffic through a space, for example to an entrance or exit. Furniture 236 can be sized, shaped, and dimensioned to cooperatively fit within a geometric area defined by segments 100.

Segments 100 are easily disassembled relative to each other, and may be stacked and transported to a location for use or storage quickly and without difficulty, expertise, or special tools. As such, panels can be moved and positioned by two people of modest strength.

The structures assembled using segments 100 can be temporary, used for an event such as a wedding, and then dissembled. The disclosure also contemplates the structures can be more permanent (e.g. minimum of three or four years, but other time periods are contemplated). In the case of structures for longer term use, the materials can be selected accordingly. For example, thicker polycarbonate (¼ inch or ⅜ inch in thickness) and aluminum trusses can be used. Additionally, governmental approval such as a Notice of Acceptance (NOA) issued by the municipal building code compliance office can be obtained for segments 100. A NOA can also additionally be obtained for the materials used for segments 100.

Figure 27:
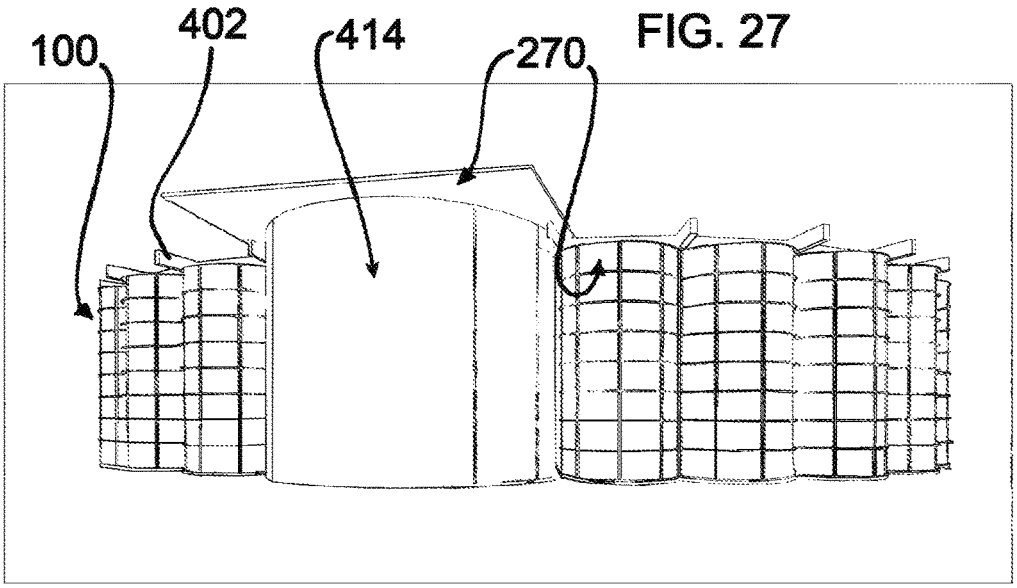
FIG. 27 depicts a perspective view of a building structure having features shown in FIG. 25.
Figure 28:
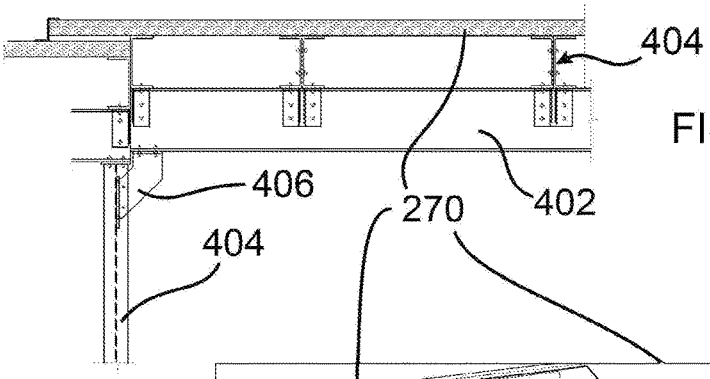
FIG. 28 depicts a support structure for a roof, such as is shown in FIGS. 25, 27, and 29.

With reference to FIG. 27, a building 400A includes a plurality of segments 300, upon which a series of struts 402 are overlaid and fastened. A series of roof panels 270 are supported by the struts 402. An example detailed structure for supporting roof panels 270 is illustrated in FIG. 28. Strut 402, in this example a metallic i-beam, is connected to a vertical stabilizing column 404, which may be located adjacent to a segment 100, may form part of the structure of segment 100, for example may function as vertical frame member 224. Alternatively, column 404 may be placed within an interior of a building formed by segments 100. In an embodiment, a concrete slab forming a foundation is initially formed upon the ground. Accordingly, columns 404 may be fastened into the foundation to provide additional stability. A gusset 406 can be provided between column 404 and strut 402 for providing additional rigidity. Transverse perlins 408, also i-beams in this example, may be provided as needed for additional strength, and for larger unsupported roof areas. To reduce weight, aluminum is advantageously used, although other materials can be used which have the requisite strength and durability, such as other metals, wood, fiberglass, or carbon fiber, as additional examples.

Figure 29:
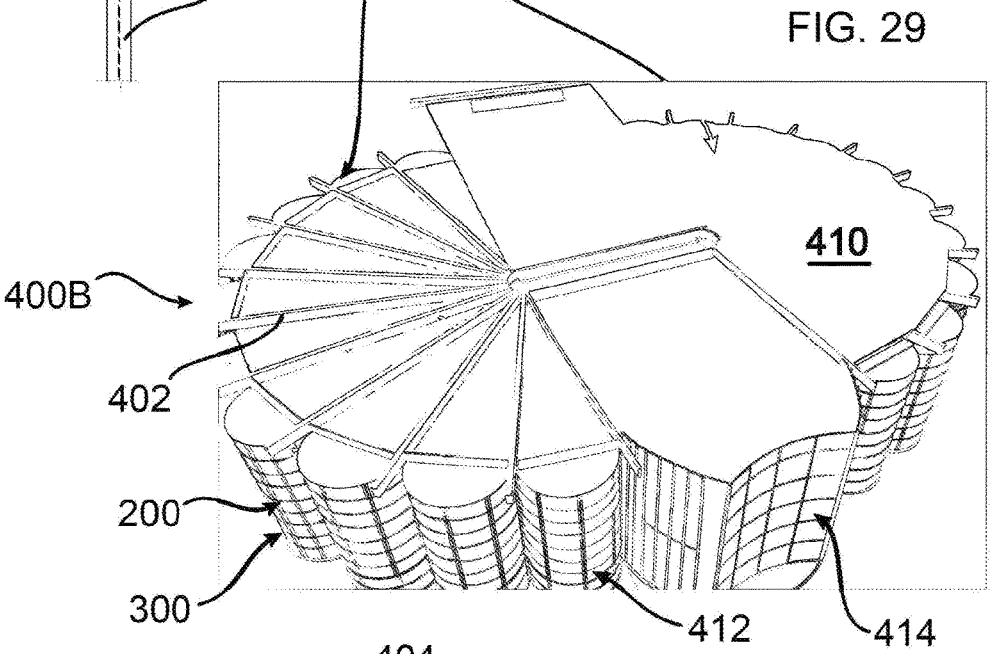
FIG. 29 depicts a model of a building structure similar to that of FIGS. 25 and 27, including partially and completely covered roof portions.

In FIG. 29, a building 400B has a portion 410, at right, completely covered by roof panels 270. At left, only seating areas 412 are covered. An atrium area 414 is depicted with a roof panel 270A repositioned so that in interior of atrium area 414 can be seen; however atrium area 414 can be provided without a roof.

Tubes 240, 242 can be used to attached roof panels 270 to segments 100. More particularly, panel 270 can be provided with one or more pins 244 which can be inserted into channels 238 within pins 240, 242, as described with respect to FIG. 24, for example.

Figure 30:
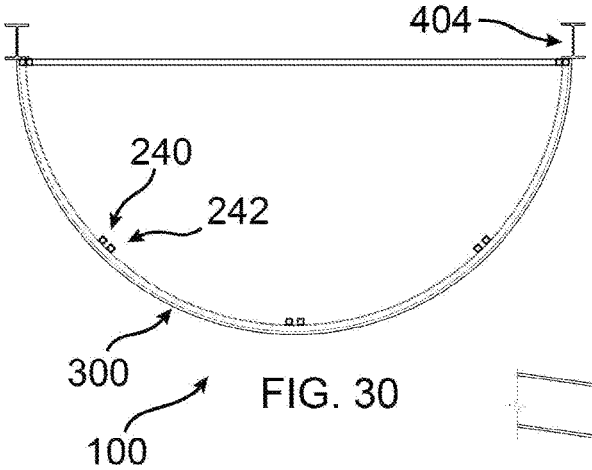
FIG. 30 depicts a segment of the disclosure, supported by vertical i-beams.

In FIG. 30, a segment 100 is constructed with two attached vertical stabilizing columns 404, which are sufficiently strong to form load bearing elements for structures with roof panels 270, or for multilevel structures. Columns 404 can be attached to left and right side portions 216, 218, or may replace left and ride side portions 216, 218. Columns 404 can be attached to panels 300 and upper and lower portions 212, 214 as described herein with respect to left and right side portions 216, 218, or by any other means such as, for example, any of welding, brazing, adhesive, threaded fastener, rivets, clips, or clamps. In another embodiment, columns 404 are not attached to segments 100, and may be free-standing, or may be fastened to the ground, or to a foundation.

Figure 31:
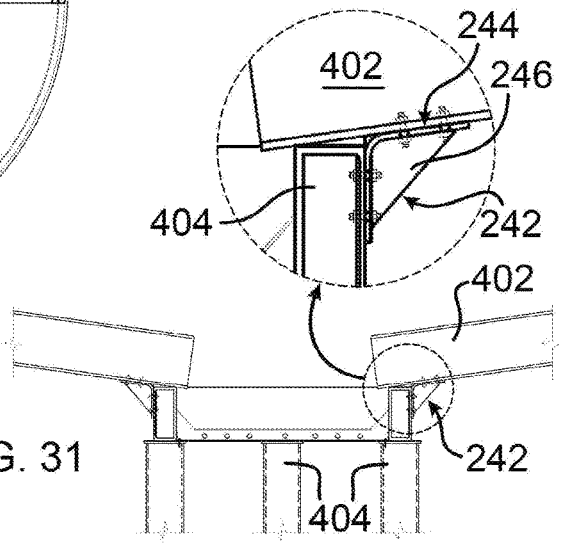
FIG. 31 depicts roof support trusses supported by central columns.

FIG. 31 illustrates one possible manner of attaching a strut 402 to a vertical column 404, and one or both ends of strut 402, or midway along a length of strut 402. More particularly, a bracket 242 having a bent plate 244 attached to strut 402 and column 404. In this example, bracket 242 includes a gusset 246 which maintains the bend angle of plate 244 under load.

As such, the disclosure provides a transparent "load bearing" structural curved segments 100 that can support readily attached "click-in" accessories. The accessories can be decorative and/or functional, and include items illustrated herein, such as curtains, lights, counter tops, and shelves, for example. The segments 100 form modular units that can be connected vertically and horizontally. The segments can be assembled at a site with an intention to form either a temporary or permanent structure. They assembled panels are capable of complying with government certifications for strength and safety as dwellings, including impact resistance to hurricane force winds. They are additionally secure against water intrusion, negative pressure, and high winds.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. A method of standing a wall segment upon a surface, comprising:
- positioning a wall segment upon the surface, the wall segment having:
  - a lower ground contacting surface,
  - an upper surface opposite the lower ground contacting surface,
  - left and a right side surfaces each extending from the lower surface to the upper surface,
  - one or more panels, and
  - a curved frame including at least one frame segment sized and dimensioned to retain a panel, the frame defining a curved outer periphery where the segment contacts the surface;
- positioning a vessel proximate the curved frame, the vessel shaped to conform and nest into the curvature of the outer periphery of the frame where the segment contacts the surface;
- attaching the vessel to the frame; and
- adding weight to the vessel,
- wherein the lower and upper surfaces are curved, and the left and right sides are curved.

2. The method of claim 1, wherein the lower surface of the wall segment that is positioned forms the arcuate portion of the periphery of a cylinder, the cylinder having a circular or elliptical cross-section.

3. The method of claim 2, wherein the frame forms a half-cylinder standing on end when positioned upon the surface.

4. The method of claim 2, wherein the portion of a periphery of a cylinder is the peripheral portion of the cylinder defining an arc of between 10 and 180 degrees.

5. The method of claim 1, wherein the lower and upper surfaces each define a first curvature extending from the left to the right side, and the left and right surfaces each define a second curvature extending from the lower to the upper side.

6. The method of claim 5 wherein the first and second curvatures are different.

7. The method of claim 1, wherein the frame of the wall segment positioned is formed from rigid tubes.

8. The method of claim 1, wherein the panels are polymeric sheets that are at least one of transparent and translucent.

9. The method of claim 1, wherein the weight added to the vessel is water.

10. The method of claim 1, wherein the vessel is a basin for holding a liquid.

11. The method of claim 10, further including clamping the basin to the frame.

12. The method of claim 1, further including connecting a first leg of an L-shaped bracket to the frame, and positioning a second leg of the L-shaped bracket beneath the vessel.

13. The method of claim 12, further including positioning an end of a bracket into an interior of the vessel, and connecting the bracket to the frame.

14. A wall segment, comprising:
- a first frame forming a lower surface, an upper surface opposite the lower surface, and left and right side surfaces each extending from the lower surface to the upper surface, the frame forming one or more interior frame segments, the lower surface forming a curve defining an interior surface of the frame, the upper surface forming a curve;
- one or more panels that are one of transparent and translucent, each of the one or more panels sized and dimensioned to fit within one of the frame segments of the frame;
- a basin having a side forming a complementary curve with respect to a curve of the frame, the basin thereby mateably positionable and nestable within the curve of the lower surface;
- a first bracket connectable to the frame, a portion of the first bracket positionable under the basin; and
- a second bracket connectable to the frame, a portion of the second bracket positionable within the basin.

15. The wall segment of claim 14, further including:
- at least one first tube vertically mounted to the first frame proximate the upper surface of the first frame to dispose an open channel formed by the tube proximate the upper surface of the first frame;

a second frame as in claim 14, the second frame having a second tube vertically mounted to the second frame proximate the lower surface of the second frame to dispose an open channel formed by the tube proximate the lower surface; and the first and second tube aligned when the second frame is positioned on top of the first frame with the lower surface of the second frame in overlapping conformity to the upper surface of the first frame, one or more of the open channels of the at least one first tubes thereby aligned with an open channel of the second tube, an elongate object positionable within the aligned open channels to secure a position of the second frame on top of the first frame.

16. The wall segment of claim 14, wherein the one or more panels are each attached within a frame segment using adhesive.

17. An edifice formed using a plurality of wall segments of claim 14, and further including one or more struts and at least one vertical column, the one or more struts each connected to a wall segment and at least one of the at least one vertical column.

18. An edifice, comprising:

a plurality of wall segments, each including a first frame forming a lower surface, an upper surface opposite the lower surface, and left and right side surfaces each extending from the lower surface to the upper surface, the frame forming one or more interior frame segments, the lower surface forming a curve defining an interior surface of the frame, the upper surface forming a curve, and one or more panels each sized and dimensioned to fit within one of the frame segments of the frame;

one or more struts; and a vertical column, the one or more struts each connected to a wall segment and fanning out radially from the vertical column.

19. The edifice of claim 18, wherein the panels are polymeric sheets that are at least one of transparent and translucent.

* * * * *